United States Patent [19]

Sotome et al.

[11] Patent Number: 4,962,712

[45] Date of Patent: Oct. 16, 1990

[54] DEVICE FOR DRAWING TOWEL CLOTH

[75] Inventors: Kenichi Sotome, Tochigi; Munetaka Nagasaki, Kadoma, both of Japan

[73] Assignee: SSMC Inc., Edison, N.J.

[21] Appl. No.: 338,689

[22] Filed: Apr. 17, 1989

[30] Foreign Application Priority Data

Jun. 7, 1988 [JP] Japan ..... 63-74794[U]

[51] Int. Cl.[5] ..... D05B 35/00

[52] U.S. Cl. ..... 112/121.26; 112/121.12; 112/305; 112/307

[58] Field of Search ..... 112/121.26, 305, 307, 112/121.12

[56] References Cited

U.S. PATENT DOCUMENTS 4,388,879 6/1983 Everall, Jr. et al. ..... 112/307

4,595,133 6/1986 Brocklehurst ..... 112/121.12

4,607,582 8/1986 Brocklehurst ..... 112/121.12

*Primary Examiner*—Andrew M. Falik

*Attorney, Agent, or Firm*—Theodore Jay

[57] ABSTRACT

A pair of first and second working tables which are oppositely disposed and defining a space therebetween. Provided at the first working table is a detector for identifying a thickness of a plain fabric portion from that of a pile fabric portion of a towel cloth. Provided also at the first working table this is a cutting unit spaced from the detector in a predetermined interval for cutting the towel cloth. Provided at the second working table is a base plate on which a clamping unit is mounted for clamping and drawing the towel cloth. Over the space between the first and the second working tables there is provided a towel cloth drawing unit across the towel cloth and movable vertically for drawing the towel cloth from a towel material.

7 Claims, 3 Drawing Sheets

DEVICE FOR DRAWING TOWEL CLOTH

BACKGROUND OF THE INVENTION

1. Field of the Invention

The present invention relates to a device for drawing a towel material having a pile fabric portion and a plain fabric portion which are continuous one after the other and for cutting the plain fabric portion to prepare a towel cloth.

2. Prior Art

A prior art cutting device for cutting the plain fabric portion of towel material employs identification means for identifying the pile fabric portion and the plain fabric portion by identifying their different thicknesses, different sizes, or differences in light transmittances. The identification means can utilize a pair of rollers combined with an optical sensor.

A prior art device for drawing the towel cloth, as disclosed, for example, in Japanese Patent Laid-Open Publication No. 60-75667, comprises a drawing unit for clamping the plain fabric portion of the towel cloth between a movable clamping member and a fixed clamping member and then moving the succeeding plain fabric portion between an upper positioning member and a lower positioning member. A presser roller means composed of a plurality of presser roller elements draws a tip end of a succeeding pile fabric portion into a receiving portion defined by the upper and the lower positioning members after completion of the movement of the previous plain fabric portion. A feeding roller means is used which is provided with a slip means corresponding to each presser roller elements.

The towel material has various sizes depending on usage thereof such as a hand towel and a bath towel. Accordingly, there are problems in the prior art device because a long and strong cutting device is required for cutting large sized towel cloth since a long distance of movement of the drawing device is needed. Small sized towels cannot be cut with this device; a much shorter device is required.

SUMMARY OF THE INVENTION

It is an object of the present invention to provide a device for drawing and cutting towel cloth which is easily adapted for drawing and cutting towel clothes of different sizes and which utilizes a compact and simple structure.

To achieve the object of the present invention, a device for drawing towel cloth comprises a pair of first and second working tables integrated with an automatic sewing machine and respectively disposed oppositely while defining a space therebetween. A thickness separator disposed at an end of the first working table for passing a plain fabric portion and blocking a pile fabric portion of a towel cloth as the cloth is delivered to the first working table. A cutting unit extends across the first working table and is spaced by a predetermined amount from the dectector for cutting the towel cloth. A towel cloth drawing unit extends over the space between the first and the second working tables across the towel cloth and is movable vertically for drawing the towel cloth from the towel material. A clamping unit mounted on a base plate disposed on the second working table and movable toward the second working table clamps and draws the towel cloth.

The above and other objects, features and advantages of the present invention will become more apparent from the following description taken in conjunction with the accompanying drawing.

BRIEF DESCRIPTION OF THE DRAWINGS

FIG. 2(*b*) is a side view of the towel cloth of FIG. 2(*a*);

PREFERRED EMBODIMENT OF THE INVENTION

Figure 2:
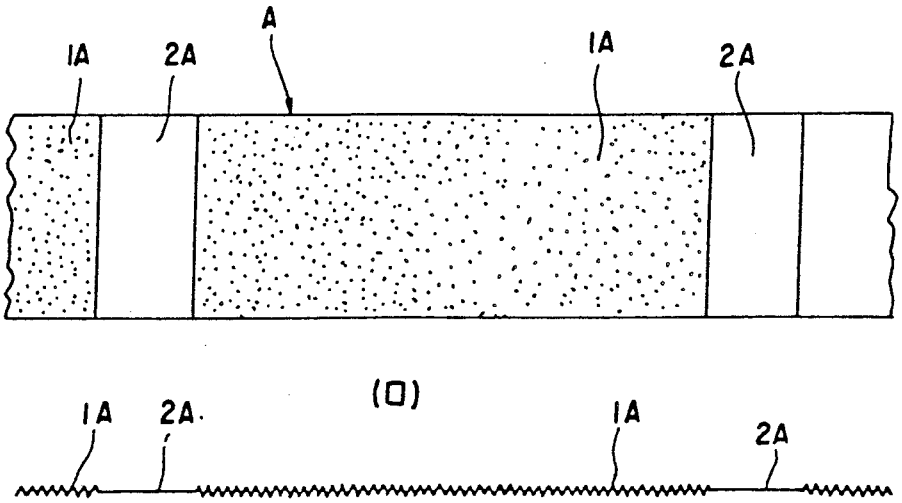
FIG. 2 (*a*) is a plan view showing a towel material having plain and pile fabric portion continuous one after the other which is used in the device for drawing towel cloth of FIG. 1.

A towel cloth A used in the present invention comprises a single pile fabric portion 1A and a single plain fabric portion 2A. The towel cloth A is prepared by drawing a towel material of long size as illustrated in FIG. 2 in which the pile fabric portion 1A and the plain fabric portion 2A are continuous one after the other, and cutting the plain fabric portion 2A.

Figure 1:
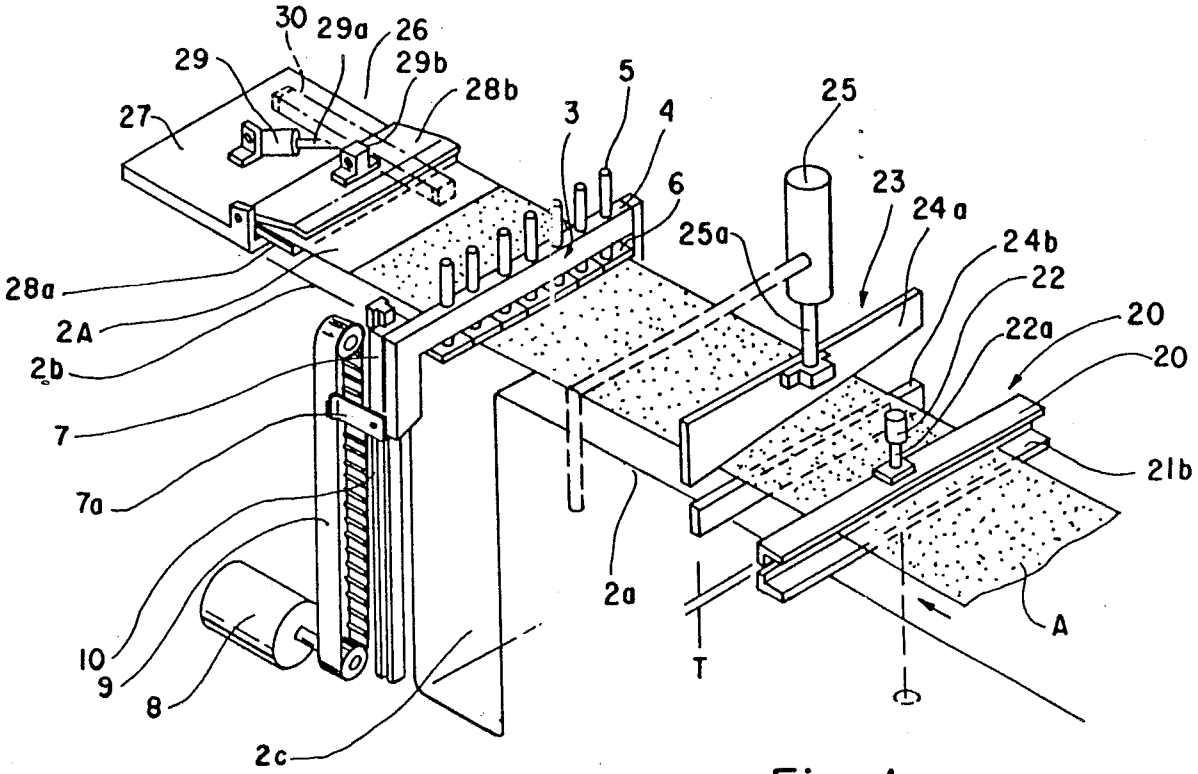
FIG. 1 is a perspective view showing a device for drawing towel cloth according to a prefered embodiment of the present invention.
Figure 3:
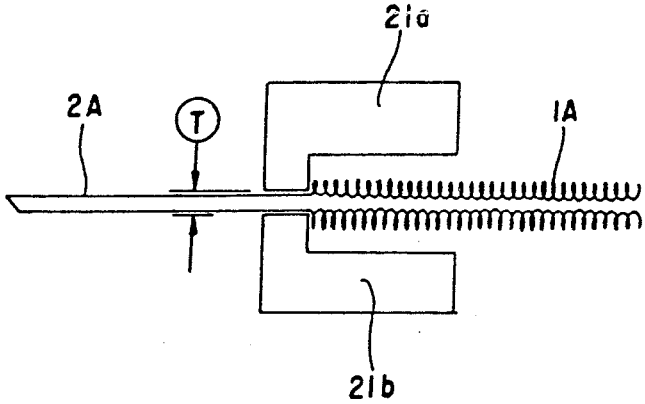
FIG. 3 is a detail side view of the separator employed in the device for drawing towel cloth of FIG. 1.

A preferred embodiment of the present invention will be described with reference to FIGS. 1 to 3.

The device for drawing towel cloth comprises a pair of first and second working tables 2*a*, 2*b* integral with a body of an automatic sewing machine 1 and respectively disposed oppositely and defining a space 2*c* therebetween. A separator 20 provided at an end of the first working table 2*a* for passing therethrough the plain fabric portion 2A and blocking passage of the pile fabric portion 1A of a towel cloth A delivered to the first working table 2*a*. A cutting unit 23 extends across the first working table 2*a* and spaced from the separator 20 by a predetermined distance for cutting the towel cloth A. A towel cloth drawing unit 3 extends over the space 2*c* across the towel cloth in the longitudinal direction thereof and is movable vertically for drawing the towel cloth A from the towel material. A clamping unit 26 is mounted on a base plate 27 which is provided on the second working table 2*b* and movable toward the first working table 2*a* for clamping and drawing the towel cloth A.

The separator 20 is composed of an upper block 21*a* and a lower block 21*b* respectively disposed across the first working table 2*a* and a pneumatic cylinder 22 for positioning the upper and the lower blocks 21*a*, 21*b*. The upper block 21*a* is fixed to a tip end of a piston rod 22*a* of the pneumatic cylinder 22 fixed to the body of the automatic sewing machine 1 via a supporter while the lower block 21*b* is fixed to the body of the automatic sewing machine 1 via a supporter. The upper and the lower blocks 21*a* and 21*b* define a slit T therebetween which is regulated by lowering the upper block 21*a* by the forward actuation of the pneumatic cylinder 22 to define a stoppage gap T for permitting the plain fabric portion 2A to pass therefrom but preventing or blocking the pile portion 1A from passing therefrom.

The cutting unit 23 is composed of a movable cutter 24*a* fixed to a tip end of a piston rod 25*a* of a pneumatic cylinder 25 secured to the body of the automatic sewing machine 1 via a supporter and a stationary cutter 24*b* secured to the automatic sewing machine 1 via a supporter (not shown). The pneumatic cylinder unit 25 is actuated to move reciprocally to move the movable cutter 24*a* toward the fixed cutter 24*b* whereby the towel material A positioned between the movable cutter 24*a* and the fixed cutter 24*b* is cut off and then to move the cutter 24*a* and the fixed cutter 24*b* is cut off and then to move the cutter 24*a* away from cutter 24*b*.

The towel cloth drawing unit 3 includes an L-shaped towel cloth lowering member 4 extending across the towel cloth A. A plurality of pneumatic cylinders 5 each having pistons penetrating the towel cloth lowering member 4 are arranged in a predetermined interval. A plurality of presser pieces 6 are each secured to an end of the piston rod without interfering with each other for contacting and pressing the surface of the towel cloth. A bracket 7 is secured to an end of the towel cloth lowering unit 4 and has a belt clip 7*a* secured to the bracket 7 engaged with a timing belt 9. Belt 9 is driven by a drive motor 8 provided at a side of the automatic sewing machine 1. A guide rail 10 is disposed in parallel with the timing belt 9 for guiding the bracket 7. The towel cloth lowering member 4 is moved upward by the drive motor 8 for permitting a clamping unit 6 (described later) to pass between the towel cloth lowering member 4 and the towel cloth A. The towel cloth lowering member 4 is lowered by the drive motor 8 when the clamping unit 26 holds the plain fabric portion 2A of the towel cloth A and starts to return to the original position for thereby drawing the towel cloth A from the towel material.

The clamping units 26 includes a base plate 27 slidable on the second table 2*a* in the longitudinal direction of movement of the towel cloth A toward the second table 2*b*. A fixed metal piece 28*a* projects from an end of the base plate 27. A movable metal piece 28*b* is disposed opposite the fixed metal piece 28*a* and is swingably pivotally supported by a bracket on the base plate 27. A pneumatic cylinder 29 has a piston rod 29*a* for actuating the movable metal piece 28*b*. The pneumatic cylinder 29 is swingable mounted on a bracket on the base plate 27 at the end thereof while the tip end of the piston rod is pivotally mounted on an attached member 29*b* secured to the movable metal piece 28*b*. The pneumatic cylinder unit 29 is actuated forwardly, namely, to permit the movable metal piece 28*b* to move toward the fixed metal piece 28*a* so that the towel cloth A positioned between the movable metal piece 28*b* and the fixed metal piece 28*a* is held between the movable metal piece 28*b* and the fixed metal piece 28*a*. The pneumatic cylinder unit 29 is actuated rearwardly, namely to permit the movable metal piece 28*b* to move away from the fixed metal piece 28*a* in order to release the clamped towel cloth A.

An actuation means 30 for moving the clamping unit 26 has a movable part fixed to the lower surface of the base plate 27 and a stationary part fixed to the body of the automatic sewing machine 1, the device 30 being a known pneumatic cylinder. The actuation means 30 may be composed of a rack fixed to the base plate 27 and a pinion fixed to the body of the automatic sewing machine 1.

An operation of the device for drawing towel cloth according to the present invention will be described with reference to FIGS. 4(*a*), 4(*b*) and 4(*c*).

Figure 4A:
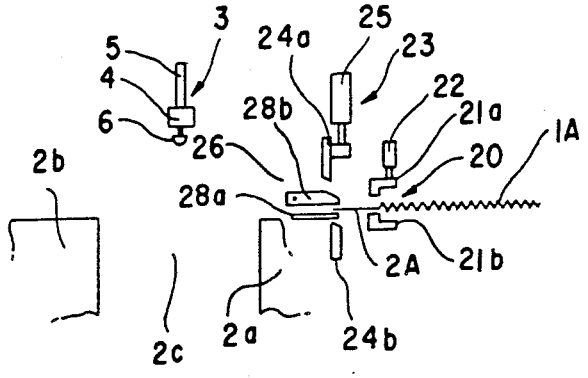
FIGS. 4(*a*), (b*b*), and (*c*) are respectively views of assistance in explaining operations of the device for drawing towel cloth of FIG. 1.
Figure 4B:
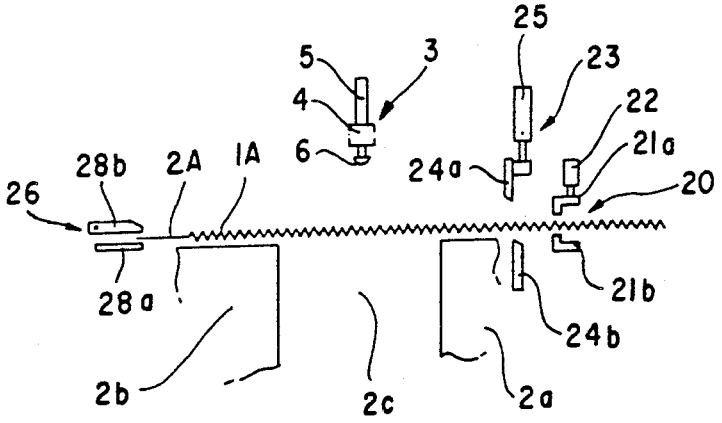
Figure 4C:
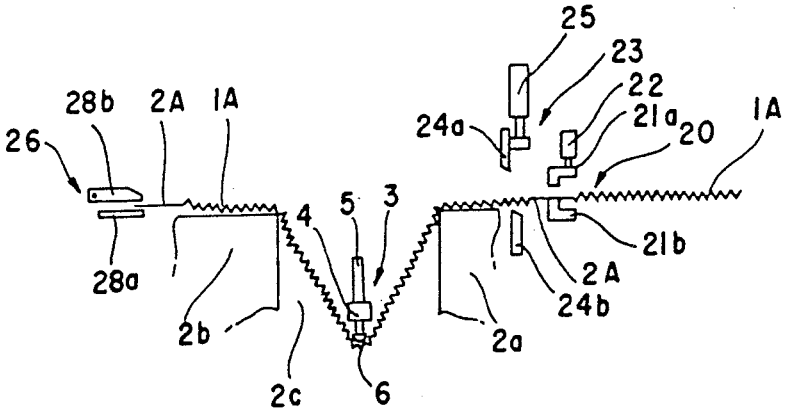

The clamping unit 26 is inserted into an opening defined between the movable cutter 24*a* and the fixed cutter 24*b* by the forward movement of the actuation means 30 in a state as illustrated in FIG. 4(*a*) so that the movable metal piece 28*b* and the fixed metal piece 28*a* clamp the end portion of the plain fabric portion 2A of the towel cloth A. In the state of FIG. 4(*a*), firstly, the towel cloth drawing unit 3 is in a upward position by the normal actuation of the drive motor 8, secondly, the movable cutter 24*a* of the cutting unit 23 is in an upward position by the reverse actuation of the pneumatic cylinder 25, thirdly, the upper block of the thickness detector 20 is in an upward position 21*a* by the reverse actuation of the pneumatic cylinder 22 so that the thick pile fabric portion 1A of the towel cloth A passes through the opening.

When initializing switch on the control box (not illustrated) is turned ON, each unit returns to its home position. When operating switch on the control box is turned ON, the signal from the sequencer on a control box (not illustrated) actuated the cylinder 29 to make its return stroke and thus open the movable metal piece 28*b*.

At the same time, the signal from the sequencer actuates a pneumatic cylinder (not illustrated) in the actuation means 30 and clamping unit 26 enters the opening of the cutting unit 23. As the clamping unit 26 enters the opening of the cutting unit 23, the plate provided on the underside of the base plate 27 pushes the shock absorber provided on the second working table 2*b* to stop the forward movement and stops the pneumatic cylinder.

At this instant, the sensor on the shock absorber is actuated and the signal from this sensor is input in the sequencer. The signal from the sequencer causes the cylinder 29 to make its forward movement and thus close the movable metal piece 28*b* clamping the plain weave portion 2A of the towel cloth.

In a state as illustrated in FIG. 4(*b*), the towel cloth A is drawn to a predetermined position by moving the clamping unit 26 backward by the backward actuation of the actuation means 30.

The timer in the control box is activated simultaneously with the closing of movable metal piece 28*b* and after preset time has passed it activates the pneumatic cylinder (not illustrated) in the actuation means 30 which in turn actuates the clamp unit 26 to make its return movement.

As the clamp unit 26 moves backward, the plate on the underside of the base plate 27 pushes the shock absorber on the second working table 2*b* to stop the return movement and stops the pneumatic cylinder. At this instant, the sensor on the shock absorber is actuated and the signal from this sensor is input in the sequencer.

In a state as illustrated in FIG. 4(*c*), the towel cloth drawing unit 3 is lowered by a reverse actuation of the drive motor 8 to thereby lower the pile fabric portion 1A of the towel cloth A in the direction of the space 2*c* between the first and the second working tables 2*a*, 2*b* while pressing the pile fabric portion 1A whereby the rear portion of the succeeding plain fabric portion 2A is positioned in the slit T defined between the upper and the lower blocks 21*a* and 21*b*.

When signal from the sensor is input in the sequencer, the sequencer transmits the signal to the pulse generator which in turn transmits the number of pulse signal preset by means of stroke counter on the control panel to the drive motor 8. The drive motor then rotates in reverse lowering the towel cloth drawing unit 3.

With a series of the operations as illustrated in FIGS. 4 (*a*), 4(*b*) and 4(*c*), a piece of the towel cloth A from the towel material is drawn by the towel cloth drawing unit 3 and the clamping unit 26, then the bending portion of the drawn towel cloth A is subjected to a correction operation by the towel cloth drawing unit 3, and finally cut off by the cutting unit 23.

In operation of the separator, pneumatic cylinder 25 moves the towel cloth so that the pile at edge of border line between pile portion/A and plain weave portion 2A will come in contact with the side faces of upper block 21*a* and lower block 21*b*. The upper block 21*a* is first lowered by the forward actuation of the pneumatic cylinder 22 to form the stoppage gap T in the slit T defined between the upper and the lower blocks 21*a*, 21*b* for permitting the thin plain fabric portion 2A to pass therethrough but preventing the thick pile fabric portion 1A from passing therethrough. Secondly, each piece 6 is lowered by the forward actuation of each pneumatic cylinder 5 for pressing the pile fabric portion 1A and individually drawing the towel cloth A affected by the piece 6, thirdly the tip portion of the succeeding pile fabric portion 1A is arranged between the slit T of the separator 20.

In summary, in a first step, the L-shaped towel cloth lowering member 4 is moved upward and the clamping unit 26 mounted on the second working table 2*b* is moved toward the first working table 2*a* and the end portion of the plain fabric portion 2A of the towel cloth A is clamped by the fixed metal piece 28*a* and the movable metal piece 28*b*.

Unit 26 starts to return to the original position. In a second step, the towel cloth lowering member 4 is lowered in the space 2*c* to draw the towel cloth until the rear end of the succeeding plain fabric portion 2A reaches the front of the separator 23.

With the arrangement of the device for drawing and cutting towel cloth according to the present invention, a piece of towel cloth is drawn tightly by the clamping unit while it bridges the space defined between the working tables, then the towel cloth is pressed to be formed in V shape by the towel cloth drawing unit and fully drawn thereby. As a result, the device of the present invention can be shortened. Furthermore, the device of the present invention is adapted for cutting various sizes of towel cloth by adjusting a pressing amount or a lowering distance of the towel cloth in the space between the working tables made by the towel cloth drawing unit while the detector and the clamping unit is spaced in the predetermined interval. As a result, the device of the present invention is widely utilized in the field of the invention.

Inasmuch as the towel cloth is pressed and lowered into the space by the towel cloth drawing unit and fed to the succeeding step, there is no interruption of a series of operations.

Although the invention has been described in its preferred form, it is to be understood that many variations and changes are possible in the invention without departing from the scope thereof.

What is claimed is:

1. A device for drawing and cutting towel cloth from towel material having lengths of pile fabric longitudinally, each pair of adjacent lengths of pile fabric being separated by an intervening length of plain fabric, said device comprising:

first and second work tables integral with an automatic sewing machine body, the tables being disposed opposite and spaced apart from each other;

a separator disposed at an end of the first table remote from the second table to receive towel material supplied thereto, the separator blocking passage of the pile fabric lengths while passing therethrough the plain fabric lengths;

a cutting unit extending across the first table and disposed between the end of the first table adjacent the second table and the separator;

a towel cloth drawing unit extending over the space between the first and the second tables across the table cloth and movable vertically for drawing the towel cloth into the space between the tables;

a clamping unit mounted on a base plate which is disposed on the second working table and is movable thereon toward the first working table for clamping and drawing the towel cloth across said tables and said space.

2. The device of claim 1 wherein the separator is composed of an upper block and a lower block respectively disposed across the first working table and a pneumatic cylinder for positioning the upper and the lower blocks, said upper block being fixed to a tip end of a piston rod of a pneumatic cylinder which is secured to said body while the lower block is also secured to the body of the automatic sewing machine, the upper and lower blocks being separated by a slit defining space, the slit permitting the plain fabric portion to pass therefrom but preventing the pile portion from passing therefrom.

3. The device of claim 1 wherein the cutting unit includes a pneumatic cylinder secured to said body, a movable cutter secured to a tip end of a piston rod of said pneumatic cylinder and a stationary cutter secured to said body, the cylinder being actuated to move reciprocally to move the movable cutter toward the fixed cutter whereby the towel cloth positioned between the movable cutter and the fixed cutter is cut off and thereafter to move the movable cutter away from the fixed cutter.

4. The device of claim 1 wherein the towel cloth drawing unit includes a towel cloth lowering unit, a plurality of pneumatic cylinders each having pistons penetrating the towel cloth lowering unit and arranged in a predetermined interval, a plurality of presser pieces each secured to an end of the piston without interfering with each other for contacting and pressing the surface of the towel cloth, a bracket secured to an end of the towel cloth lowering unit and having a belt clip fixed to the bracket engaged with a timing belt which is driven by a drive motor provided at said body, and a guide rail disposed in parallel with the timing belt for guiding the bracket.

5. The device of claim 1 wherein the base plate of the clamping unit is slidable on the second table in the longitudinal direction of feed of the cloth toward the first table, a stationary metal piece projecting from an end of the base plate, a movable metal piece disposed opposite the stationary metal piece and swingably pivotally supported by a bracket on the base plate, and a pneumatic cylinder having a piston rod for actuating the movable metal piece so that the movable metal piece moves toward or away from the fixed metal piece to hold or release the towel cloth, said pneumatic cylinder being swingably mounted on a bracket on the base plate at the end thereof, the tip end of the piston rod being pivotally mounted on an attached member secured to the movable metal piece.

6. The device of claim 1 further including an actuation means for moving the clamping unit which includes a movable part secured to the lower surface of the base plate and a stationary part secured to said body.

7. The device of claim 6 wherein the actuation means includes a rack secured to the base plate and a pinion fixed to said body.

* * * * *